US008283858B2

(12) United States Patent
Yonehara et al.

(10) Patent No.: US 8,283,858 B2
(45) Date of Patent: Oct. 9, 2012

(54) ILLUMINATION DEVICE AND METHOD FOR MANUFACTURING SAME

(75) Inventors: Toshiya Yonehara, Kanagawa-ken (JP); Tomio Ono, Kanagawa-ken (JP); Shintaro Enomoto, Kanagawa-ken (JP); Keiji Sugi, Kanagawa-ken (JP); Tomoaki Sawabe, Tokyo (JP); Taeko Urano, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 12/872,281

(22) Filed: Aug. 31, 2010

(65) Prior Publication Data

US 2011/0215711 A1 Sep. 8, 2011

(30) Foreign Application Priority Data

Mar. 2, 2010 (JP) ..... 2010-045673

(51) Int. Cl.
*H01J 1/62* (2006.01)

(52) U.S. Cl. ..... 313/506; 313/501; 313/509

(58) Field of Classification Search ..... 313/498–512
See application file for complete search history.

(56) References Cited

U.S. PATENT DOCUMENTS

| | | | | |
|---|---|---|---|---|
| 2003/0164496 | A1* | 9/2003 | Do et al. | 257/40 |
| 2004/0183433 | A1* | 9/2004 | Cho et al. | 313/504 |
| 2005/0077820 | A1* | 4/2005 | Onishi et al. | 313/506 |
| 2005/0116625 | A1* | 6/2005 | Park et al. | 313/504 |
| 2006/0113901 | A1* | 6/2006 | Oh et al. | 313/504 |
| 2007/0200496 | A1* | 8/2007 | Cok et al. | 313/512 |
| 2008/0197764 | A1* | 8/2008 | Bechtel et al. | 313/499 |
| 2008/0265757 | A1 | 10/2008 | Forrest et al. | |

FOREIGN PATENT DOCUMENTS

| | | |
|---|---|---|
| JP | 10-199680 | 7/1998 |
| JP | 2000-284134 | 10/2000 |
| JP | 2003-197373 | 7/2003 |
| JP | 2003-257620 | 9/2003 |
| JP | 2005-93190 | 4/2005 |
| JP | 2006-12826 | 1/2006 |
| JP | 2006-156400 | 6/2006 |

OTHER PUBLICATIONS

U.S. Appl. No. 12/875,548, filed Sep. 3, 2010, Ono, et al.
U.S. Appl. No. 13/081,945, filed Apr. 7, 2011, Ono, et al.
Office Action issued Feb. 7, 2012 in Japanese Patent Application No. 2010-045673 (with English translation).
U.S. Appl. No. 13/413,027, filed Mar. 6, 2012, Sawabe, et al.
Office Action (with English translation) issued on Aug. 2, 2012, in counterpart Japanese Patent Appln. No. 2010-045673 (8 pages).

* cited by examiner

*Primary Examiner* — Bumsuk Won
(74) *Attorney, Agent, or Firm* — Oblon, Spivak, McClelland, Maier & Neustadt, L.L.P.

(57) ABSTRACT

According to one embodiment, an illumination device includes an organic light-emitting unit, a first electrode, a second electrode and an optical layer. The organic light-emitting unit includes an organic light-emitting layer, a first and a second major surface. The first electrode is provided on the first major surface. The second electrode is provided on the second major surface and includes a conductive layer, a first interconnection and a second interconnection. The first interconnection is electrically connected to the conductive layer and aligned in a first direction parallel to the first major surface. The second interconnection is electrically connected to the conductive layer and aligned apart from the first interconnection and parallel to the first interconnection. The optical layer is provided on a side of the second electrode opposite to the organic light-emitting unit and includes a low refractive index portion and a high refractive index portion.

18 Claims, 11 Drawing Sheets

ILLUMINATION DEVICE AND METHOD FOR MANUFACTURING SAME

CROSS-REFERENCE TO RELATED APPLICATIONS

This application is based upon and claims the benefit of priority from the prior Japanese Patent Application No. 2010-045673, filed on Mar. 2, 2010; the entire contents of which are incorporated herein by reference.

FIELD

Embodiments described herein relate generally to an illumination device and a method for manufacturing the same.

BACKGROUND

The practical use of organic light emitting devices in display devices, light sources, illumination, etc., is being studied. In an organic electroluminescent element, an organic thin film is provided between a cathode and an anode; a voltage is applied between the cathode and the anode; excitons are created; and the light emitted when the excitons undergo radiative deactivation is utilized. Materials having relatively low conductivities such as, for example, ITO (Indium Tin Oxide) are used as the anode.

In the case where an organic electroluminescent element is applied in large surface-area illumination and the like, problems are expected because the conductivity of the anode is low, a voltage drop may occur in the plane, and the brightness may become nonuniform.

Moreover, to increase the luminous efficacy, it is important to efficiently extract the light emitted in the organic light-emitting layer.

JP-A 2006-156400 (Kokai) discusses technology to increase the outcoupling efficiency of an organic electroluminescent element by providing a diffraction grating layer. However, in such a method, it is necessary to form a fine diffraction grating. Therefore, it is difficult to practically apply such a method in an illumination device having a large surface area.

Special technology is necessary to increase the outcoupling efficiency while suppressing the voltage drop in the plane to practically use an organic electroluminescent element in an illumination device having a large surface area.

DETAILED DESCRIPTION

Figure 1A:
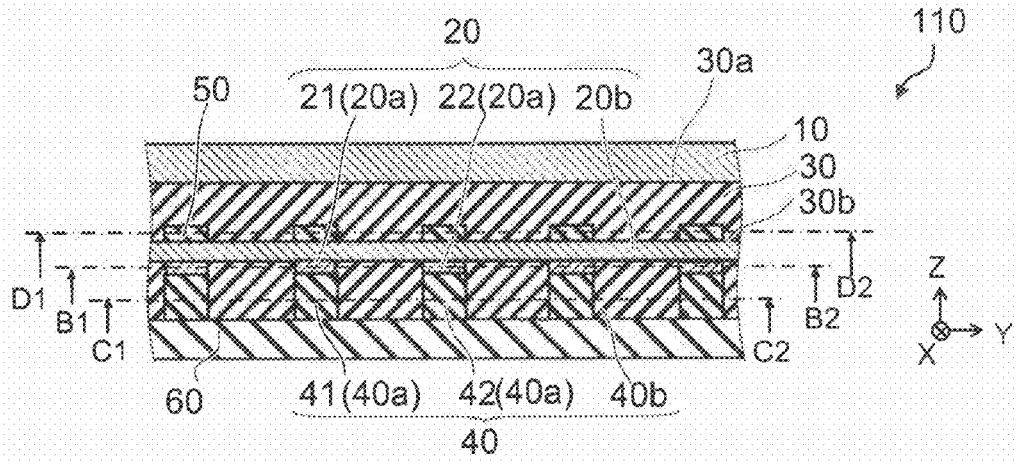
FIG. 1A and FIG. 1B are schematic views illustrating the configuration of an illumination device according to a first embodiment.

In general, according to one embodiment, an illumination device includes an organic light-emitting unit, a first electrode, a second electrode and an optical layer. The organic light-emitting unit includes an organic light-emitting layer, a first major surface, and a second major surface. The first electrode is provided on the first major surface of the organic light-emitting unit. The second electrode is provided on the second major surface of the organic light-emitting unit. The second electrode includes a conductive layer, a first interconnection and a second interconnection. The first interconnection is electrically connected to the conductive layer and aligned in a first direction parallel to the first major surface, and the first interconnection has a conductivity higher than a conductivity of the conductive layer. The second interconnection is electrically connected to the conductive layer and aligned apart from the first interconnection and parallel to the first interconnection, and the second interconnection has a conductivity higher than the conductivity of the conductive layer. The optical layer is provided on a side of the second electrode opposite to the organic light-emitting unit. The optical layer includes a low refractive index portion and a high refractive index portion. The low refractive index portion has a portion overlapping at least one selected from the first interconnection and the second interconnection as viewed from a direction perpendicular to the first major surface. The high refractive index portion has a portion contacting the portion of the low refractive index portion, the high refractive index portion having a refractive index higher than a refractive index of the low refractive index portion.

According to another embodiment, a method for manufacturing an illumination device is disclosed. The device includes an organic light-emitting unit, a first electrode, a second electrode and an optical layer. The organic light-emitting unit includes an organic light-emitting layer, a first major surface, and a second major surface. The first electrode is provided on the first major surface of the organic light-emitting unit. The second electrode is provided on the second major surface of the organic light-emitting unit. The second electrode includes a conductive layer, a first interconnection and a second interconnection. The first interconnection is electrically connected to the conductive layer and aligned in a first direction parallel to the first major surface, and the first interconnection has a conductivity higher than a conductivity of the conductive layer. The second interconnection is electrically connected to the conductive layer and aligned apart from the first interconnection and parallel to the first interconnection, and the second interconnection has a conductivity higher than the conductivity of the conductive layer. The optical layer is provided on a side of the second electrode opposite to the organic light-emitting unit. The optical layer includes a low refractive index portion and a high refractive index portion. The low refractive index portion has a portion overlapping at least one selected from the first interconnection and the second interconnection as viewed from a direction perpendicular to the first major surface. The high refractive index portion has a portion contacting the portion of the low refractive index portion, the high refractive index portion having a refractive index higher than a refractive index of the low refractive index portion. The method can include forming a low refractive index film used to form the low refractive index portion on a major surface of a substrate. The method can include forming a high conductivity film used to form the first interconnection and the second interconnection on the low refractive index film. The method can include patterning the low refractive index film and the high conductivity film to form the low refractive index portion, the first interconnection, and the second interconnection. The method can include forming the high refractive index portion on the major surface of the substrate exposed between the low refractive index portion, the first interconnection, and the second interconnection. The method can include forming the conductive layer to cover the low refractive index portion, the first interconnection, the second interconnection, and the high refractive index portion. The method can include forming a photosensitive insulating film on the conductive layer. The method can include forming an insulating layer made of the insulating film and having a patterned configuration conforming to a patterned configuration of the first interconnection and the second interconnection by using the first interconnection and the second interconnection as a mask to irradiate light onto the insulating film through the substrate and by developing. The method can include forming the organic light-emitting unit on the insulating layer and the conductive layer. In addition, the method can include forming the first electrode on the organic light-emitting unit.

Exemplary embodiments of the invention will now be described in detail with reference to the drawings.

The drawings are schematic or conceptual; and the relationships between the configuration and width of portions, the proportions of sizes among portions, etc., are not necessarily the same as the actual values thereof. Further, the dimensions and proportions may be illustrated differently among drawings, even for identical portions.

In the specification and drawings of the application, components similar to those described in regard to a drawing thereinabove are marked with like reference numerals, and a detailed description is omitted as appropriate.

First Embodiment

Figure 1B:
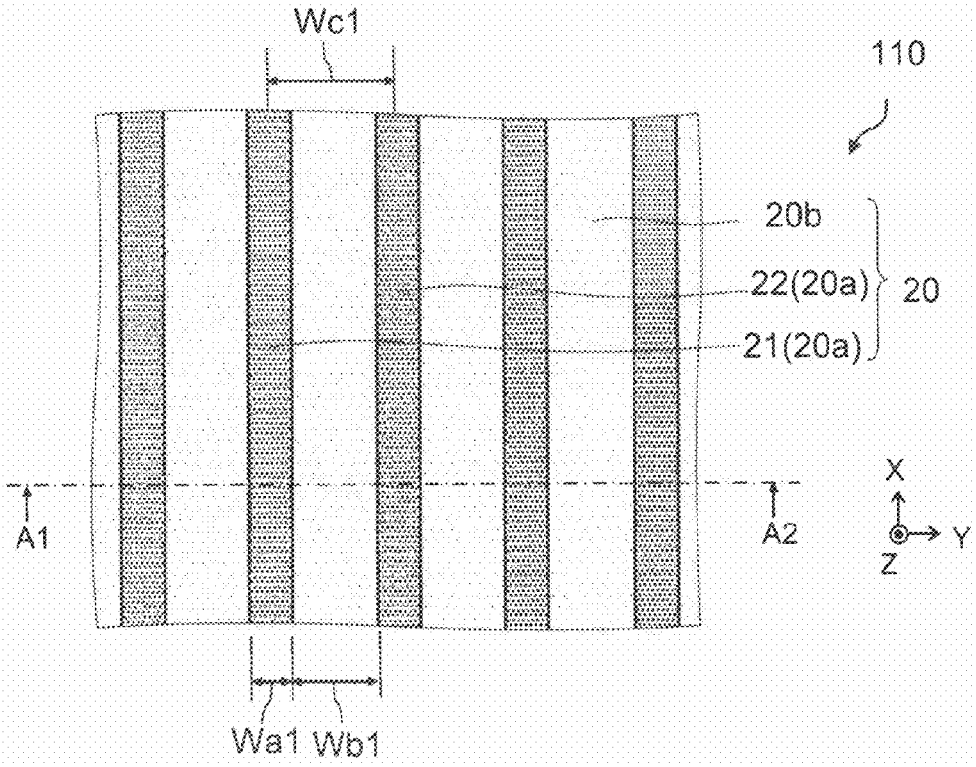

FIG. 1A and FIG. 1B are schematic views illustrating the configuration of an illumination device according to a first embodiment of the invention.

Figure 2A:
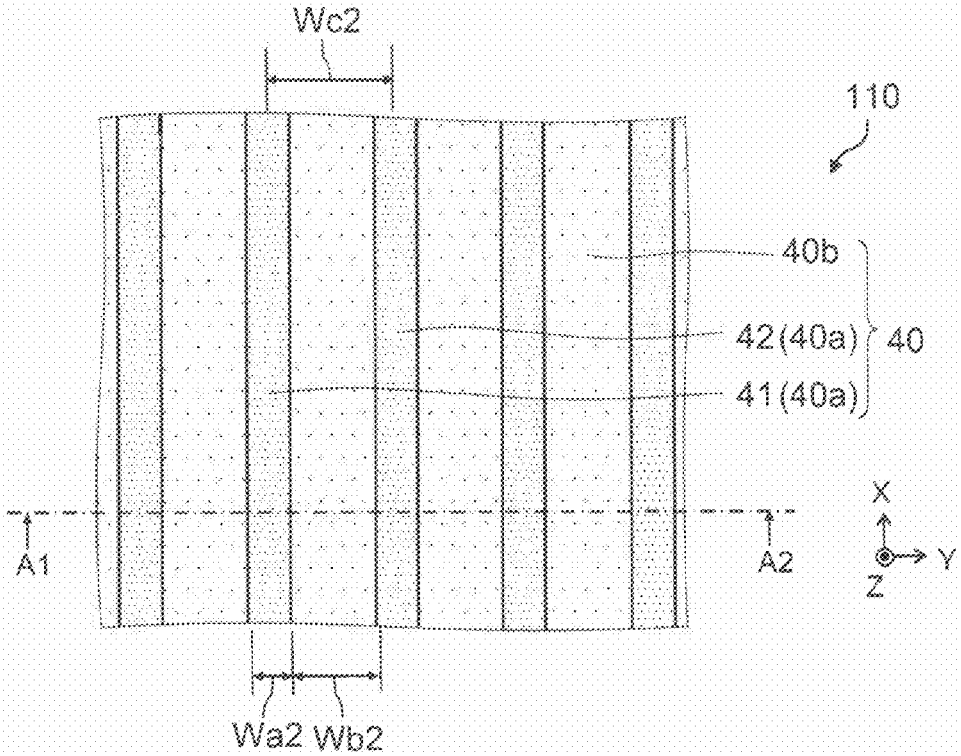
FIG. 2A and FIG. 2B are schematic views illustrating the configuration of the illumination device according to the first embodiment.
Figure 2B:
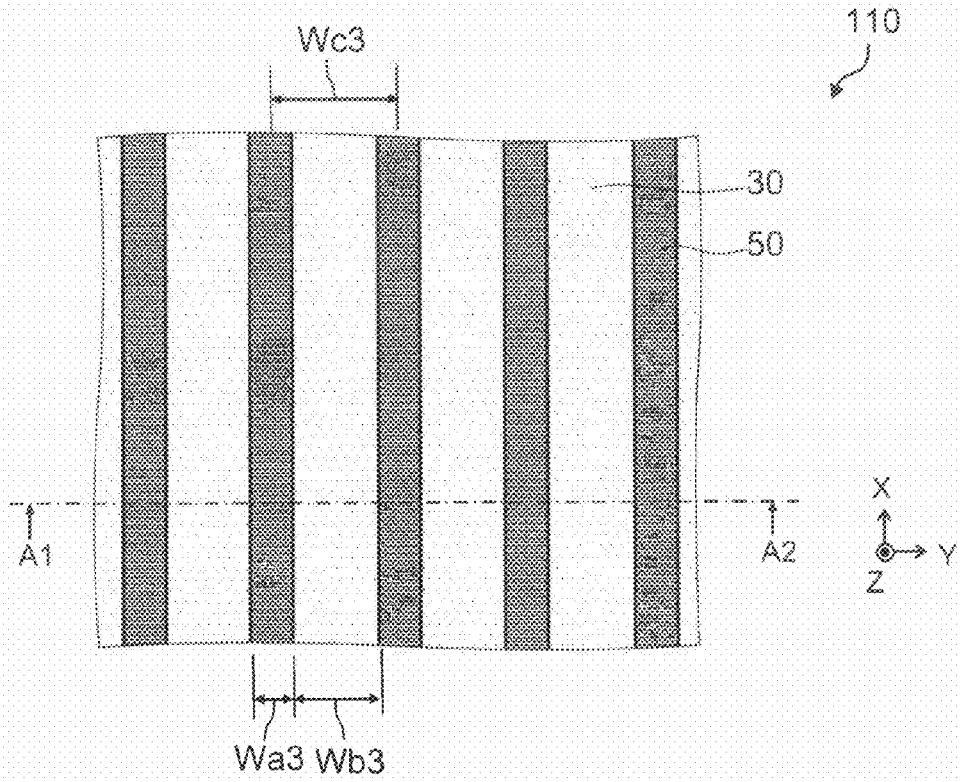

FIG. 2A and FIG. 2B are schematic views illustrating the configuration of the illumination device according to the first embodiment of the invention.

Namely, FIG. 1A is a cross-sectional view along line A1-A2 of FIG. 1B, FIG. 2A, and FIG. 2B; FIG. 1B is a cross-sectional view along line B1-B2 of FIG. 1A; FIG. 2A is a cross-sectional view along line C1-C2 of FIG. 1A; and FIG. 2B is a cross-sectional view along line D1-D2 of FIG. 1A.

As illustrated in FIGS. 1A and 1B and FIGS. 2A and 2B, the illumination device 110 according to this embodiment includes: an organic light-emitting unit 30 including an organic light-emitting layer, a first major surface 30*a*, and a second major surface 30*b*; a first electrode 10 provided on the first major surface 30*a* of the organic light-emitting unit 30; a second electrode 20 provided on the second major surface 30*b* of the organic light-emitting unit 30; and an optical layer 40 provided on the side of the second electrode 20 opposite to the organic light-emitting unit 30. In other words, the organic light-emitting unit 30 is provided between the first electrode 10 and the second electrode 20.

The organic light-emitting layer of the organic light-emitting unit 30 may include, for example, Alq3 (tris(8-hydroxyquinolinato)aluminum), and the like. However, this embodiment is not limited thereto. The organic light-emitting layer may include any material. In addition to the organic light-emitting layer, the organic light-emitting unit 30 may further include various organic films such as charge transport organic films and charge injection layers.

The first electrode 10 may include, for example, Al, Ag, and alloys of Mg:Ag, etc. However, the embodiments of the invention are not limited thereto. The first electrode 10 may include any conductive material.

Herein, a direction perpendicular to the first major surface 30*a* is taken as a Z-axis direction. The Z-axis direction is the stacking direction of the first electrode 10, the organic light-emitting unit 30, and the second electrode 20. For example, the direction from the second electrode 20 toward the first electrode 10 is the Z-axis direction. One direction perpendicular to the Z-axis direction is taken as an X-axis direction. A direction perpendicular to the Z-axis direction and the X-axis direction is taken as a Y-axis direction. The X-axis direction is taken to be a first direction; and the Y-axis direction is taken to be a second direction.

The second electrode 20 includes a conductive layer 20*b*, a first interconnection 21, and a second interconnection 22.

The conductive layer 20*b* opposes the first electrode 10 along the Z-axis direction with the organic light-emitting unit 30 interposed therebetween. The conductive layer 20*b* is parallel to the first major surface 30*a*.

The first interconnection 21 is electrically connected to the conductive layer 20*b*. The first interconnection 21 is aligned in the first direction (the X-axis direction) parallel to the first major surface 30*a*. The conductivity of the first interconnection 21 is higher than the conductivity of the conductive layer 20*b*.

The second interconnection 22 is electrically connected to the conductive layer 20*b*. The second interconnection 22 is aligned apart from the first interconnection 21 and parallel to the first interconnection 21. The conductivity of the second interconnection 22 is higher than the conductivity of the conductive layer 20*b*. The second interconnection 22 is adjacent to the first interconnection 21 along the Y-axis direction.

In this specific example, the first interconnection 21 and the second interconnection 22 are provided on the side of the conductive layer 20*b* opposite to the organic light-emitting unit 30.

The conductive layer 20*b* may include, for example, ITO; and the first interconnection 21 and the second interconnection 22 may include, for example, a metal such as Al and Cu. This embodiment is not limited thereto. It is sufficient for the conductivities of the first interconnection 21 and the second interconnection 22 to be higher than the conductivity of the conductive layer 20*b*.

The conductive layer 20*b* is transparent to light emitted from the organic light-emitting unit 30.

The transmittances of the first interconnection 21 and the second interconnection 22 with respect to the light emitted from the organic light-emitting unit 30 are lower than the transmittance of the conductive layer 20*b* with respect to the light. The first interconnection 21 and the second interconnection 22 are light-shielding with respect to the light recited above. The first interconnection 21 and the second interconnection 22 are reflective with respect to the light recited above.

The optical layer 40 includes a low refractive index portion 40*a* and a high refractive index portion 40*b*.

The low refractive index portion 40*a* has a portion overlapping at least one selected from the first interconnection 21 and the second interconnection 22 as viewed from the Z-axis direction (the direction perpendicular to the first major surface 30*a*). In other words, the low refractive index portion 40*a* has a portion opposing the at least one selected from the first interconnection 21 and the second interconnection 22 along the Z-axis direction. In this specific example, the low refractive index portion 40*a* includes a first portion 41 opposing the first interconnection 21 and a second portion 42 opposing the second interconnection 22.

The high refractive index portion 40*b* has a portion contacting the portion of the low refractive index portion 40*a* recited above (the portion recited above overlapping the at least one selected from the first interconnection 21 and the second interconnection 22 as viewed from the Z-axis direction). The refractive index of the high refractive index portion 40*b* is higher than the refractive index of the low refractive index portion 40*a*. For example, at least a portion of the high refractive index portion 40*b* contacts at least a portion of the low refractive index portion 40*a* along the Y-axis direction.

Silicon oxide, for example, may be used as the low refractive index portion 40*a*. In such a case, the refractive index is, for example, about 1.4. Polyimide, for example, may be used as the high refractive index portion 40*b*. In such a case, the refractive index is about 1.7.

As illustrated in FIG. 1A and FIG. 1B, the second electrode 20 may include other interconnections similar to the first interconnection 21 and the second interconnection 22.

In other words, the second electrode 20 may include the conductive layer 20*b* and multiple interconnections 20*a* aligned in the X-axis direction and electrically connected to the conductive layer 20*b*, where the conductivities of the interconnections 20*a* are higher than the conductivity of the conductive layer 20*b*. The number of the interconnections 20*a* may be an arbitrary number of 2 or more. In other words, the second electrode 20 may include the multiple interconnections 20*a* having band configurations aligned in the X-axis direction.

The pitch between such multiple interconnections 20*a* is arbitrary and may have equal spacing or may be changed, for example, between the end portions and the central portion of the illumination device 110.

Hereinbelow, the case is described where the pitches between the multiple interconnections 20*a* are substantially equal to each other.

In this specific example as illustrated in FIG. 2A, the low refractive index portion 40*a* is provided in the regions where the first interconnection 21 and the second interconnection 22 are provided as viewed from the direction perpendicular to the first major surface 30*a*. In other words, the low refractive index portion 40*a* is provided along the regions where the first interconnection 21 and the second interconnection 22 are provided as viewed from the direction perpendicular to the first major surface 30*a*. The low refractive index portion 40*a* has substantially the same pattern (the pattern in the X-Y plane as viewed from the direction perpendicular to the first major surface 30*a*) as the interconnection 20*a* (the first interconnection 21 and the second interconnection 22).

The first portion 41 and the second portion 42 of the low refractive index portion 40*a* are aligned in the first direction.

The high refractive index portion 40*b* is adjacent along the second direction to the portion of the low refractive index portion 40*a* recited above (e.g., the first portion 41 and the second portion 42) and contacts the portion recited above along the second direction.

In other words, the high refractive index portion 40*b* is provided in portions where the low refractive index portion 40*a* is not provided. In other words, the high refractive index portion 40*b* is provided in regions where the interconnection 20*a* (the first interconnection 21 and the second interconnection 22) is not provided. Thus, it is advantageous for the pattern of the low refractive index portion 40*a* to substantially match the pattern of the interconnection 20*a* because, as described below, the low refractive index portion 40*a* and the interconnection 20*a* can be formed collectively; and the production efficiency increases.

However, this embodiment is not limited thereto. It is sufficient for the low refractive index portion 40*a* to have a portion overlapping the interconnection 20*a* (at least one selected from the first interconnection 21 and the second interconnection 22) as viewed from the Z-axis direction and for the high refractive index portion 40*b* to have a portion contacting the low refractive index portion 40*a*.

Hereinbelow, the case is described where the low refractive index portion 40*a* has substantially the same pattern (the pattern in the X-Y plane) as the interconnection 20*a* (the first interconnection 21 and the second interconnection 22) and the high refractive index portion 40*b* is provided in the regions where the interconnection 20*a* (the first interconnection 21 and the second interconnection 22) is not provided.

As illustrated in FIG. 2B, an insulating layer 50 is provided in a region opposing the interconnection 20*a* along the Z-axis direction. The insulating layer 50 is provided between the organic light-emitting unit 30 and the second electrode 20 (in this case, the conductive layer 20*b*). In other words, the illumination device 110 further includes the insulating layer 50 provided between the second electrode 20 and the organic light-emitting unit 30, where the insulating layer 50 has a portion overlapping at least one selected from the first interconnection 21 and the second interconnection 22 as viewed from the direction perpendicular to the first major surface 30*a*. The insulating layer 50 may be provided as necessary and may be omitted.

As illustrated in FIG. 1A, a substrate 60 is provided on the side of the optical layer 40 opposite to the second electrode 20. The substrate 60 may include a material transparent to the light emitted from the organic light-emitting unit 30. A glass substrate, for example, may be used as the substrate 60. The substrate 60 may be provided as necessary and may be omitted. The substrate 60 may be provided on the side of the first electrode 10 opposite to the organic light-emitting unit 30. In such a case, the substrate 60 may be transparent or light-shielding.

Thus, in the illumination device 110 according to this embodiment, a voltage drop in the plane of the second electrode 20 can be suppressed by adding the interconnection 20*a* having a high conductivity to electrically connect to the conductive layer 20*b* made of ITO, etc., having a relatively low conductivity. Thereby, the electric field applied to the organic light-emitting unit 30 is uniform in the plane; and light emission uniform in the plane can be obtained.

Further, the transparency of the interconnection 20*a* (e.g., the first interconnection 21 and the second interconnection 22) having the high conductivity is lower than the transparency of the conductive layer 20*b*. Specifically, the interconnection 20*a* is reflective; and the low refractive index portion 40*a* is provided in the region where the interconnection 20*a* is provided. Therefore, outcoupling efficiency increases.

In other words, an object of this embodiment is to solve the problems that newly occur when putting an illumination device using an organic electroluminescent element having a large surface area into practical use, that is, to suppress the voltage drop in the plane and increase the outcoupling efficiency. Such problems can be solved by applying the combination of the conductive layer 20*b* and the interconnection 20*a* having the conductivity higher than that of the conductive layer 20*b* and further applying the combination of the high refractive index portion 40*b* and the low refractive index portion 40*a*.

Figure 3:
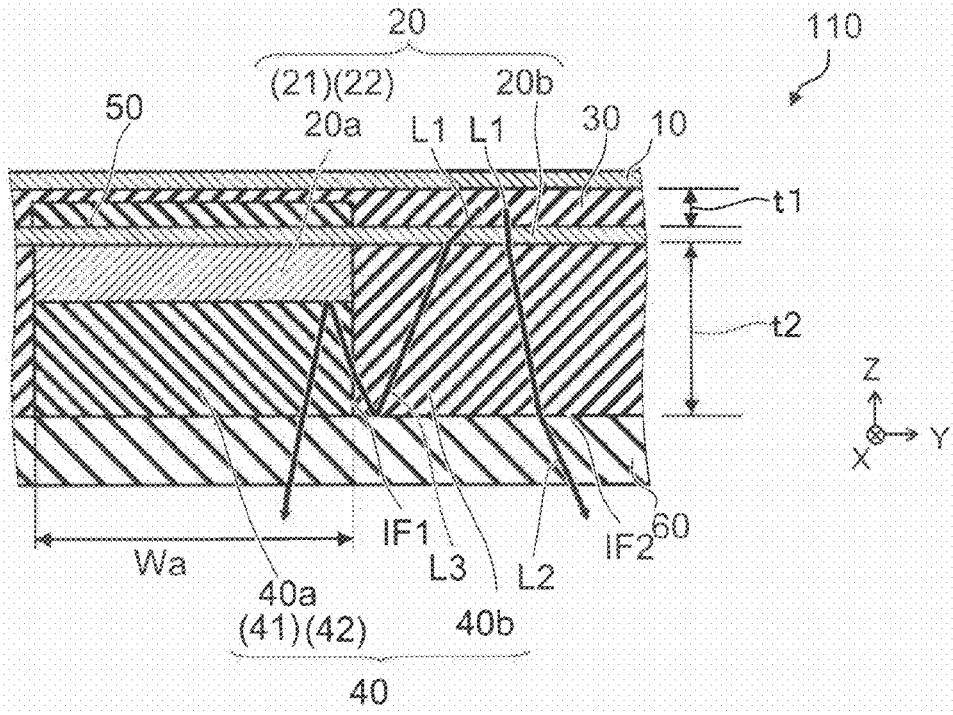
FIG. 3 is a schematic view illustrating operations of the illumination device according to the first embodiment.

FIG. 3 is a schematic view illustrating operations of the illumination device according to the first embodiment of the invention.

As illustrated in FIG. 3, an electric field is applied to the organic light-emitting unit 30 when a voltage is applied between the first electrode 10 and the second electrode 20. The electric field causes the organic light-emitting unit 30 to emit light L1. The light L1 passes through the conductive layer 20*b* of the second electrode 20, enters the high refractive index portion 40*b* of the optical layer 40, and travels through the high refractive index portion 40*b*. Light L2, i.e., a portion of the light L1, is emitted to the external environment from the high refractive index portion 40*b*. In this specific example, the light L2, i.e., the portion of the light L1, is emitted to the external environment from the high refractive index portion 40*b* through the substrate 60.

Light L3, i.e., one other portion of the light L1, is reflected by the face of the high refractive index portion 40*b* on the side opposite to the second electrode 20 (in this specific example, an interface IF2 between the high refractive index portion 40*b* and the substrate 60) and once again travels through the interior of the high refractive index portion 40*b*. At this time, the low refractive index portion 40*a* is provided adjacent to the high refractive index portion 40*b*; and the light L3 enters the low refractive index portion 40*a*. Because the refractive index of the low refractive index portion 40*a* is lower than that of the high refractive index portion 40*b*, the angle of the optical path of the light L3 changes at an interface IF1 (corresponding to the side face of the low refractive index portion 40*a*) between the high refractive index portion 40*b* and the low refractive index portion 40*a*.

In other words, an incident angle $\theta_b$ on the high refractive index portion 40*b* side and an emergence angle $\theta_a$ on the low refractive index portion 40*a* side are related by Snell's law by $n_a \cdot \sin\theta_a = n_b \cdot \sin\theta_b$ at the interface IF1, where a low refractive index $n_a$ is the refractive index of the low refractive index portion 40*a* and a high refractive index $n_b$ is the refractive index of the high refractive index portion 40*b*.

Thus, the light radiated from the organic light-emitting unit 30 (in this case, the light L3) is refracted based on the difference of the refractive index between the low refractive index portion 40*a* and the high refractive index portion 40*b* when traveling from the high refractive index portion 40*b* into the low refractive index portion 40*a*.

Thus, the optical path of the light L3 changes at the interface IF1 (corresponding to the side face of the low refractive index portion 40*a*) between the high refractive index portion 40*b* and the low refractive index portion 40*a*; and the light L3 travels through the interior of the low refractive index portion 40*a*, is reflected by the interconnection 20*a*, once again passes through the low refractive index portion 40*a*, and is extracted to the external environment.

In the case of a comparative example in which the refractive index in the optical layer 40 is uniform (e.g., the low refractive index portion 40*a* is not provided and the entire optical layer 40 is the high refractive index portion 40*b*), the angle of the optical path of the light L3 does not change in the interior of the optical layer 40; and the light L3 undergoes multiple reflections inside the optical layer 40, is absorbed inside the optical layer 40, and is difficult to extract to the outside. Therefore, the efficiency is low in the comparative example.

Conversely, in the illumination device 110 according to this embodiment, the high refractive index portion 40*b* and the low refractive index portion 40*a* are provided in the optical layer 40. Therefore, the optical path of the light L3 changes at the interface IF1 thereof; the multiple reflections can be suppressed; and the light L3 can be easily extracted to the external environment. Thus, the efficiency is high in the illumination device 110.

Further, the low refractive index portion 40*a* is designed to have a portion overlapping the interconnection 20*a* (the first interconnection 21 and the second interconnection 22) as viewed from the Z-axis direction; and the low refractive index portion 40*a* opposes the interconnection 20*a* along the Z-axis direction. Therefore, the light L3 traveling through the low refractive index portion 40*a* can be efficiently reflected by the interconnection 20*a*; and the efficiency can be increased.

It is desirable for the refractive index of the high refractive index portion 40*b* to be higher than the refractive index of the organic light-emitting unit 30. Thereby, the light L1, L2, and L3 emitted in the organic light-emitting unit 30 can efficiently enter the high refractive index portion 40*b* from the organic light-emitting unit 30 and easily be extracted to the external environment.

Further, in this specific example, the insulating layer 50 having a portion overlapping the interconnection 20*a* as viewed from the Z-axis direction is provided. The insulating layer 50 opposes the interconnection 20*a* along the Z-axis direction. The insulating layer 50 insulates the organic light-emitting unit 30 from the portion of the conductive layer 20*b* opposing the interconnection 20*a*. Therefore, the electric field applied to the portion of the organic light-emitting unit 30 where the insulating layer 50 is provided is lower than at the other portions. As described above, the transparency of the interconnection 20*a* is lower than the transparency of the conductive layer 20*b*. Therefore, the light emitted at the portion opposing the interconnection 20*a* is not easily extracted to the outside. In the illumination device 110, the insulating layer 50 is provided at the portion opposing the interconnection 20*a*; and the emission of the light of the organic light-emitting unit 30 at the portion where it is difficult to extract the light is suppressed more than at the other portions. Therefore, the efficiency increases further.

As illustrated in FIG. 1B, a width Wa1 of the interconnection 20*a* along the second direction (i.e., the width of the first interconnection 21 along the Y-axis direction and the width of the second interconnection 22 along the Y-axis direction) is greater than the peak wavelength of the light emitted from the organic light-emitting unit 30. In other words, specifically, the width Wa1 is greater than 10 micrometers (μm). Thereby, the resistance of the interconnection 20*a* can be reduced and it is easy to obtain a uniform light emission in the plane by increasing the width Wa1 of the interconnection 20*a* to at least a certain amount. In the case where the width of the interconnection 20*a* is reduced too much, it is difficult to pattern the interconnection 20*a*; and the productivity may decrease.

By setting the width Wa1 of the interconnection 20*a* along the Y-axis direction greater than the peak wavelength of the light emitted from the organic light-emitting unit 30 and not less than 10 μm, the width of the low refractive index portion 40*a* provided conforming to the region where the interconnection 20*a* is provided can be greater than the peak wavelength of the light; the effects of the refraction recited above can be obtained; and the outcoupling efficiency increases.

Moreover, a width Wb1 of the conductive layer 20*b* along the Y-axis direction where the interconnection 20*a* is not provided is wider than the width Wa1 of the interconnection 20*a* along the Y-axis direction. Thereby, light can be extracted efficiently via the conductive layer 20*b* having the high transmittance.

For example, the pitch of the interconnection 20*a* along the Y-axis direction may be at least twice the width Wa1 of the interconnection 20*a* along the second direction. A distance Wc1 along the Y-axis direction from the center of the first interconnection 21 along the Y-axis direction to the center of the second interconnection 22 along the Y-axis direction may be at least twice the width Wa1 of the interconnection 20*a* along the second direction. Thereby, a high opening ratio can be ensured.

Moreover, the pitch of the interconnection 20*a* along the Y-axis direction may be at least 10 times the width Wa1 of the interconnection 20*a* along the second direction. The distance Wc1 along the Y-axis direction from the center of the first interconnection 21 along the Y-axis direction to the center of the second interconnection 22 along the Y-axis direction may be at least 10 times the width Wa1 of the interconnection 20*a* along the second direction. Thereby, a high opening ratio of about 80% can be ensured.

As illustrated in FIG. 2A, a width Wa2 of the low refractive index portion 40*a* along the second direction (i.e., the width of the first portion 41 along the Y-axis direction and the width of the second portion 42 along the Y-axis direction) may be greater than the peak wavelength of the light emitted from the organic light-emitting unit 30. Thereby, the effects of the refraction recited above are obtained; and the outcoupling efficiency increases.

A width Wb2 of the high refractive index portion 40*b* along the Y-axis direction is wider than the width Wa2 of the low refractive index portion 40*a* along the Y-axis direction. In other words, the low refractive index portion 40*a* is provided opposing the interconnection 20*a*; and the high refractive index portion 40*b* is provided opposing the portions of the second electrode 20 (the conductive layer 20*b*) where the interconnection 20*a* is not provided.

The pitch of the low refractive index portion 40*a* along the Y-axis direction may be at least twice the width Wa2 of the low refractive index portion 40*a* along the second direction and may be set substantially the same as the distance Wc1. In other words, a distance Wc2 along the Y-axis direction from the center of the first portion 41 along the Y-axis direction to the center of the second portion 42 along the Y-axis direction may be at least twice the width Wa2 of the low refractive index portion 40*a* along the second direction. The distance Wc2 may be set to be substantially the same as the distance Wc1. Thereby, a high opening ratio can be ensured.

Moreover, the pitch of the low refractive index portion 40*a* along the Y-axis direction may be at least 10 times the width Wa2 of the low refractive index portion 40*a* along the second direction and may be set to be substantially the same as the distance Wc1. In other words, the distance Wc2 along the Y-axis direction from the center of the first portion 41 along the Y-axis direction to the center of the second portion 42 along the Y-axis direction may be at least 10 times the width Wa2 of the low refractive index portion 40*a* along the second direction. The distance Wc2 may be set to be substantially the same as the distance Wc1. Thereby, a high opening ratio of about 80% can be ensured.

In this specific example as illustrated in FIG. 2B, a width Wa3 of the insulating layer 50 along the Y-axis direction is set to be substantially the same as the width Wa1 and the width Wa2.

A width Wb3 along the Y-axis direction between the insulating layers 50 is set to be substantially the same as the width Wb1 and the width Wb2.

A distance Wc3, i.e., the pitch of the insulating layer 50 along the Y-axis direction, may be at least twice the width Wa3 of the insulating layer 50 along the Y-axis direction and may be set to be substantially the same as the distance Wc1 and the distance Wc2. Thereby, a high opening ratio can be ensured.

Moreover, the distance Wc3, i.e., the pitch of the insulating layer 50 along the Y-axis direction, may be at least 10 times the width Wa3 of the insulating layer 50 along the Y-axis direction and may be set to be substantially the same as the distance Wc1 and the distance Wc2. Thereby, a high opening ratio of about 80% can be ensured.

The width Wa1 of the interconnection 20*a* along the Y-axis direction may be set to be, for example, not less than 10 μm and not more than 1000 μm. In the case where the width Wa1 is narrower than 10 μm, it may be difficult to pattern the interconnection 20*a* when constructing an illumination device having a large surface area. In the case where the width Wa1 is greater than 1000 μm, it is difficult to have a high opening ratio while suppressing nonuniformity due to the voltage drop in the plane.

The pitch of the interconnection 20*a* along the Y-axis direction (i.e., the distance Wc1 along the Y-axis direction from the center of the first interconnection 21 along the Y-axis direction to the center of the second interconnection 22 along the Y-axis direction) may be not less than 100 μm and not more than 10 mm. It is undesirable for the pitch of the interconnection 20*a* to be less than 100 μm because the opening ratio easily decreases. In the case where the pitch of the interconnection 20*a* is greater than 10 mm, the brightness may become nonuniform in the plane.

It is desirable for the width along the Y-axis direction of the portion of the low refractive index portion 40*a* (e.g., the first portion 41 and the second portion 42) overlapping the at least one selected from the first interconnection 21 and the second interconnection 22 as viewed from the direction perpendicular to the first major surface to be not less than 100 μm and not more than 1000 μm, that is, equal to the width of the interconnection 20*a* along the Y-axis direction.

As illustrated in FIG. 3, a thickness t2 of the high refractive index portion 40*b* along the Z-axis direction is greater than the organic light-emitting unit 30 thickness (a distance t1). The distance t1 may be set to be, for example, not less than 100 nanometers (nm) and not more than 300 nm; and the thickness t2 may be not less than 1 μm and not more than 100 μm.

Figure 4A:
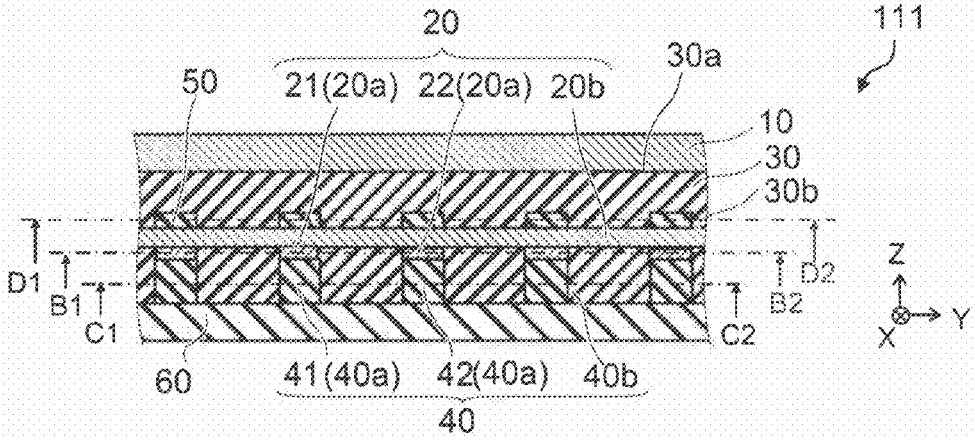
FIG. 4A and FIG. 4B are schematic views illustrating the configuration of another illumination device according to the first embodiment.
Figure 4B:
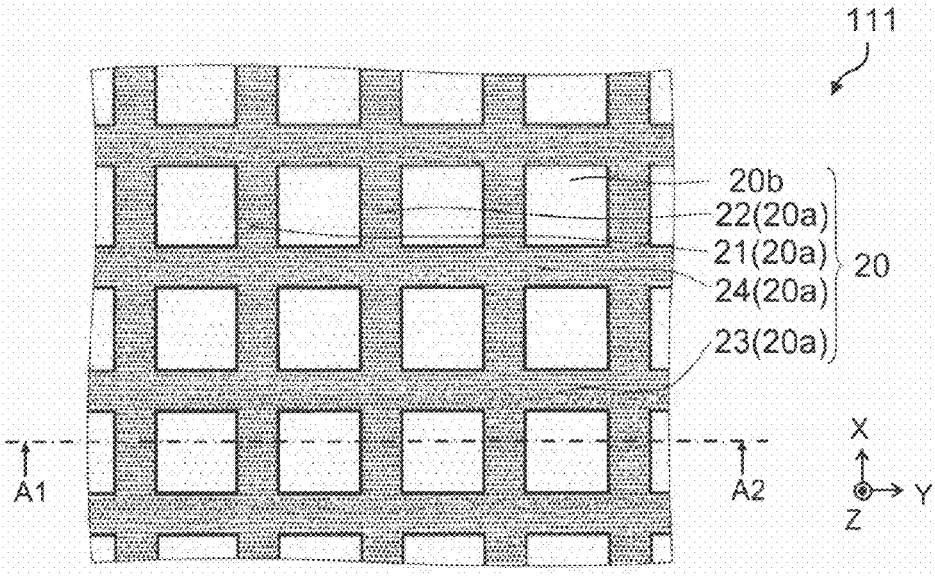

FIG. 4A and FIG. 4B are schematic views illustrating the configuration of another illumination device according to the first embodiment of the invention.

Figure 5A:
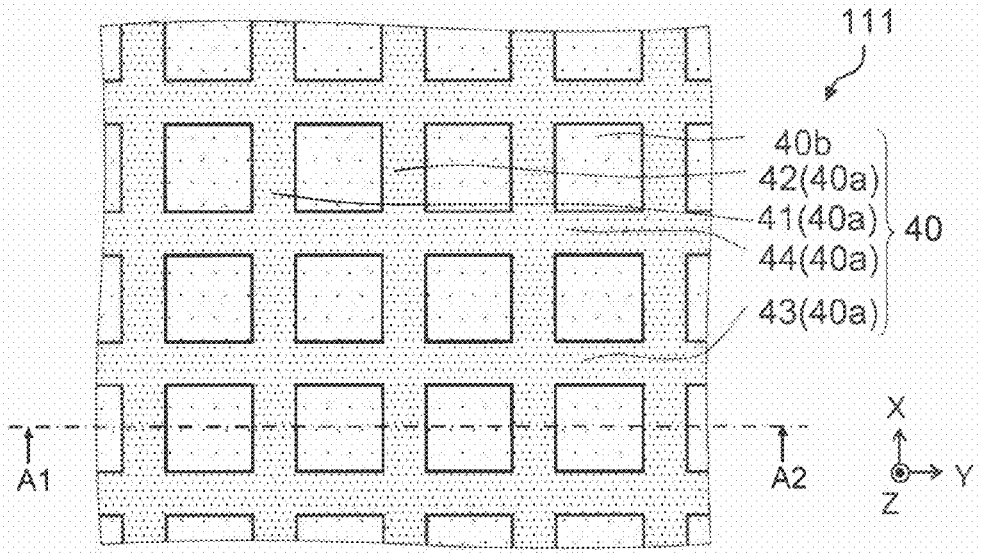
FIG. 5A and FIG. 5B are schematic views illustrating the configuration of the another illumination device according to the first embodiment.
Figure 5B:
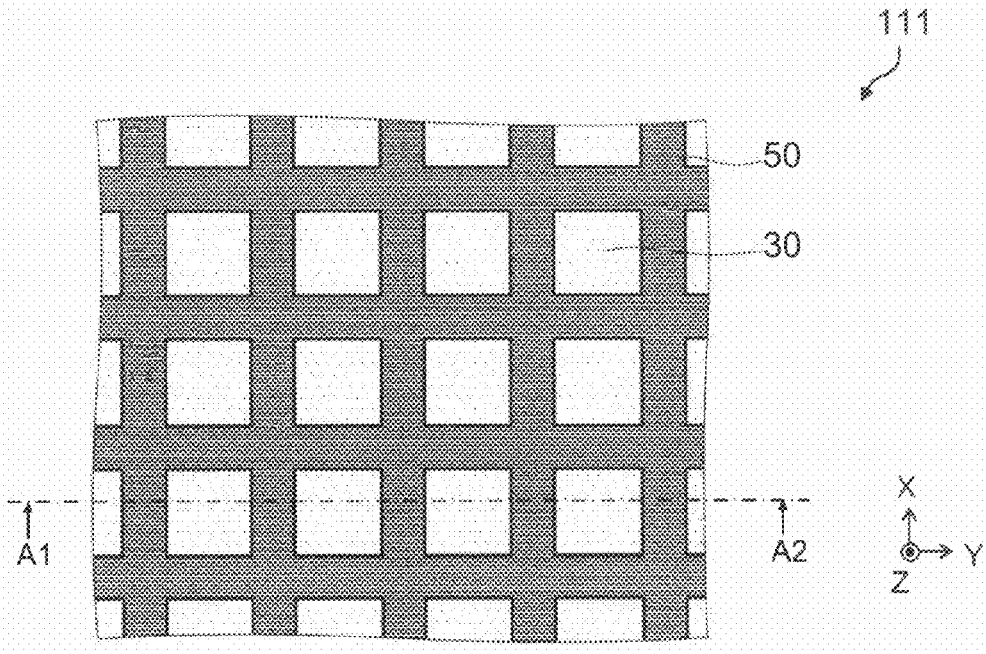

FIG. 5A and FIG. 5B are schematic views illustrating the configuration of the another illumination device according to the first embodiment of the invention.

Namely, FIG. 4A is a cross-sectional view along line A1-A2 of FIG. 4B, FIG. 5A, and FIG. 5B; FIG. 4B is a cross-sectional view along line B1-B2 of FIG. 4A; FIG. 5A is a cross-sectional view along line C1-C2 of FIG. 4A; and FIG. 5B is a cross-sectional view along line D1-D2 of FIG. 4A.

As illustrated in FIGS. 4A and 4B and FIGS. 5A and 5B, the one other illumination device 111 according to this embodiment includes the first electrode 10, the second electrode 20, the organic light-emitting unit 30, and the optical layer 40 described above. However, in the illumination device 111, the second electrode 20 further includes a third interconnection 23 and a fourth interconnection 24.

The third interconnection 23 is electrically connected to the conductive layer 20*b*, the first interconnection 21 and the second interconnection 22. The third interconnection 23 is aligned in a third direction different from the first direction and parallel to the first major surface. The conductivity of the third interconnection 23 is higher than that of the conductive layer 20*b*.

The fourth interconnection 24 is electrically connected to the conductive layer 20*b*, the first interconnection 21, and the second interconnection 22. The fourth interconnection 24 is aligned apart from the third interconnection 23 and parallel to the third interconnection 23. In other words, the fourth interconnection 24 is aligned in the third direction. The conductivity of the fourth interconnection 24 also is higher than that of the conductive layer 20*b*.

In this specific example, the third direction is taken to be a direction orthogonal to the first direction. In other words, the third interconnection 23 is aligned in the Y-axis direction. The fourth interconnection 24 also is aligned in the Y-axis direction.

The distances along the Z-axis direction between the third interconnection 23 and the first electrode 10 and between the fourth interconnection 24 and the first electrode 10 are substantially the same as the distances along the Z-axis direction between the first interconnection 21 and the first electrode 10 and between the second interconnection 22 and the first electrode 10. In other words, the third interconnection 23 and the fourth interconnection 24 are in the same layer as the first interconnection 21 and the second interconnection 22. The material used as the third interconnection 23 and the fourth interconnection 24 may be the same material used as the first interconnection 21 and the second interconnection 22. The third interconnection 23 and the fourth interconnection 24 may be formed collectively with the first interconnection 21 and the second interconnection 22. Thereby, it is possible to efficiently construct the first to fourth interconnections 21 to 24.

Thus, in the illumination device 111, the interconnection 20*a* having a conductivity higher than that of the conductive layer 20*b* is provided in a grid along the X-axis direction and the Y-axis direction.

Thereby, even in the case where the illumination device 111 is an illumination device with a large surface area having both a long X-axis direction length and a long Y-axis direction length, the voltage drop can be suppressed in both the X-axis direction and the Y-axis direction; and it is possible to obtain a uniform brightness.

As illustrated in FIG. 5A, the low refractive index portion 40*a* of the optical layer 40 further has a portion overlapping at least one selected from the third interconnection 23 and the fourth interconnection 24 as viewed from the direction perpendicular to the first major surface 30*a* (the Z-axis direction). In other words, the low refractive index portion 40*a* may include a third portion 43 opposing the third interconnection 23 along the Z-axis direction. Also, the low refractive index portion 40*a* may include a fourth portion 44 opposing the fourth interconnection 24 along the Z-axis direction.

In this specific example, the low refractive index portion 40*a* is provided in the regions where the first interconnection 21, the second interconnection 22, the third interconnection 23, and the fourth interconnection 24 are provided as viewed from the direction perpendicular to the first major surface 30*a*. In other words, the low refractive index portion 40*a* is provided conforming to the regions where the first interconnection 21, the second interconnection 22, the third interconnection 23, and the fourth interconnection 24 are provided as viewed from the direction perpendicular to the first major surface 30*a*. The low refractive index portion 40*a* has substantially the same pattern (the pattern in the X-Y plane as viewed from the direction perpendicular to the first major surface 30*a*) as the interconnection 20*a* (the first interconnection 21, the second interconnection 22, the third interconnection 23, and the fourth interconnection 24).

The first portion 41 and the second portion 42 of the low refractive index portion 40*a* are aligned in the first direction (the X-axis direction); and the third portion 43 and the fourth portion 44 of the low refractive index portion 40*a* are aligned in the second direction (the Y-axis direction).

The high refractive index portion 40*b* has portions adjacent along the second direction to the first portion 41 and the second portion 42 of the low refractive index portion 40*a* to contact the first portion 41 and the second portion 42 along the second direction. Further, the high refractive index portion 40*b* has portions adjacent along the first direction to the third portion 43 and the fourth portion 44 of the low refractive index portion 40*a* to contact the third portion 43 and the fourth portion 44 along the first direction.

In other words, the high refractive index portion 40*b* is provided in the portions where the low refractive index portion 40*a* is not provided. In other words, the high refractive index portion 40*b* is provided in the regions where the interconnection 20*a* (the first interconnection 21, the second interconnection 22, the third interconnection 23, and the fourth interconnection 24) is not provided. Thus, it is advantageous for the pattern of the low refractive index portion 40*a* to substantially match the pattern of the interconnection 20*a* because, as described below, the low refractive index portion 40*a* and the interconnection 20*a* can be formed collectively; and the production efficiency increases.

Thus, the low refractive index portion 40*a* is provided to oppose the third interconnection 23 and the fourth interconnection 24. Thereby, the light L3 is efficiently extracted to the external environment due to the effects of the refraction described in regard to FIG. 3. Thereby, a high efficiency can be obtained. Thereby, the voltage drop in the plane can be suppressed to obtain a uniform brightness; and a highly efficient illumination device with increased outcoupling efficiency can be provided.

By further providing the insulating layer 50 to oppose the third interconnection 23 and the fourth interconnection 24 in the Z-axis direction as illustrated in FIG. 5B, the light emission of the organic light-emitting unit 30 at the portions where it is difficult to extract the light (the portions opposing the third interconnection 23 and the fourth interconnection 24) can be suppressed more than at the other portions; and the efficiency increases further.

In the illumination device 111, it is desirable to set the width of the third interconnection 23 along a fourth direction (in this case, the X-axis direction) perpendicular to the third direction and parallel to the first major surface 30*a* and the width of the fourth interconnection 24 along the fourth direction to be greater than the peak wavelength of the light emitted from the organic light-emitting unit 30. Thereby, the resistances of the third interconnection 23 and the fourth interconnection 24 can be set lower than a constant value; and the voltage drop in the plane can be effectively suppressed.

It is desirable to set the distance along the fourth direction from the center of the third interconnection 23 along the fourth direction to the center of the fourth interconnection 24 along the fourth direction to be not less than 10 times the width of the third interconnection 23 along the fourth direction and not less than 10 times the width of the fourth interconnection 24 along the fourth direction. Thereby, a high opening ratio can be obtained; the outcoupling efficiency can be increased; and a high efficiency is easily obtained.

An example of a method for manufacturing the illumination device 110 and the illumination device 111 according to this embodiment will now be described.

FIG. 6A to FIG. 6G are schematic cross-sectional views in order of the processes, illustrating the method for manufacturing the illumination devices according to the first embodiment of the invention.

Namely, FIG. 6A to FIG. 6G illustrate the method for manufacturing the illumination device 110 or the illumination device 111 and are cross-sectional views corresponding to the cross section along line A1-A2 of FIG. 1B or FIG. 4B.

Figure 6A:
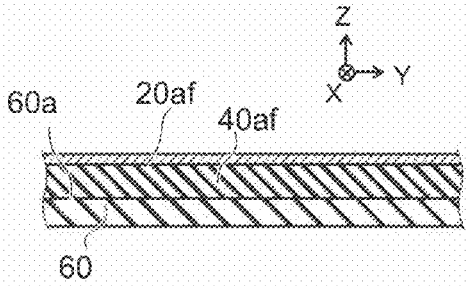
FIG. 6A to FIG. 6G are schematic cross-sectional views in order of the processes, illustrating a method for manufacturing the illumination devices according to the first embodiment.

First, as illustrated in FIG. 6A, a low refractive index film 40*af* used to form the low refractive index portion 40*a* is formed on a major surface 60*a* of the substrate 60 made of, for example, glass, etc.; and a high conductivity film 20*af* used to form the first interconnection 21 and the second interconnection 22 is formed on the low refractive index film 40*af*. $SiO_2$, for example, may be used as the low refractive index film 40*af*. The thickness of the low refractive index film 40*af* may be, for example, not less than 1 μm and not more than 100 μm. The forming of the low refractive index film 40*af* may include any method such as vapor deposition and coating. Al, for example, may be used as the high conductivity film 20*af*. The thickness of the high conductivity film 20*af* may be, for example, not less than 20 nm and not more than 1000 nm. The forming of the high conductivity film 20*af* may include vapor deposition such as sputtering, etc.

Figure 6B:
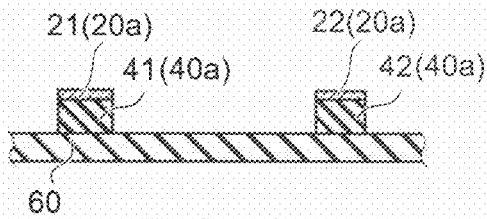

Then, as illustrated in FIG. 6B, the low refractive index film 40*af* and the high conductivity film 20*af* are patterned to form the first interconnection 21 and the second interconnection (the interconnection 20*a*) and the low refractive index portion 40*a*. Such patterning may be performed using, for example, photolithography; and such patterning may be performed collectively. By appropriately designing the configuration of the mask during the photolithography, the third interconnection 23 and the fourth interconnection 24 can be collectively provided simultaneously with the low refractive index portion 40*a*, the first interconnection 21, and the second interconnection 22.

Figure 6C:
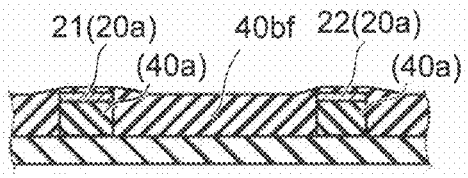

Then, as illustrated in FIG. 6C, the high refractive index portion 40*b* is formed on the major surface 60*a* of the substrate 60 exposed between the low refractive index portion 40*a*, the first interconnection 21, and the second interconnection 22.

In this specific example, a high refractive index film 40*bf* used to form the high refractive index portion 40*b* is formed to cover the low refractive index portion 40*a*, the first interconnection 21, the second interconnection 22, and the major surface 60*a* of the substrate 60. Polyimide, for example, may be used as the high refractive index film 40*bf*.

Figure 6D:
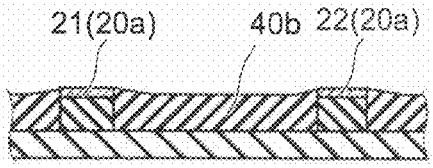

Then, as illustrated in FIG. 6D, etch-back is performed on the high refractive index film 40*bf* to expose the first interconnection 21 and the second interconnection 22. Thus, the high refractive index portion 40*b* is formed.

Figure 6E:
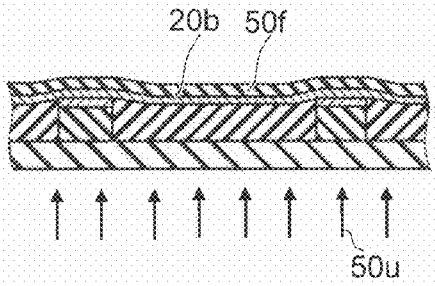

Continuing as illustrated in FIG. 6E, the conductive layer 20*b* is formed to cover the low refractive index portion 40*a*, the first interconnection 21, the second interconnection 22, and the high refractive index portion 40*b*. ITO, for example, may be used as the conductive layer 20*b*. The thickness of the conductive layer 20*b* may be 50 nm to 200 nm. The forming of the conductive layer 20*b* may include any method such as sputtering and coating.

Then, a photosensitive insulating film 50*f* is formed on the conductive layer 20*b*. For example, a positive photosensitive acrylic resin and the like may be used as the insulating film 50*f*.

Then, light 50*u* is irradiated onto the insulating film 50*f* from the face of the substrate 60 on the side opposite to the major surface 60*a* using the first interconnection 21 and the second interconnection 22 as a mask. Namely, light 50*u* is irradiated onto the insulating film 50*f* through the substrate 60 using the first interconnection 21 and the second interconnection 22 as a mask. The photosensitive insulating film 50*f* is photosensitive to energy of the light 50*u*. Subsequently, developing is performed. Thereby, the portions of the insulating film 50*f* irradiated with the light 50*u* are removed; and the portions that are screened by the first interconnection 21 and the second interconnection 22 and are not irradiated with the light 50*u* remain.

Figure 6F:
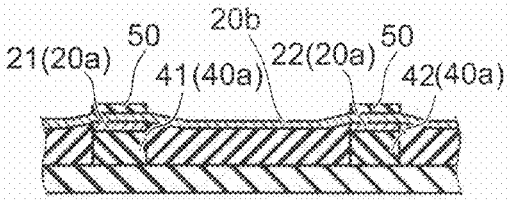

Thereby, as illustrated in FIG. 6F, the insulating layer 50 made of the insulating film 50*f* is formed with a patterned configuration conforming to the patterned configuration of the first interconnection 21 and the second interconnection 22.

Figure 6G:
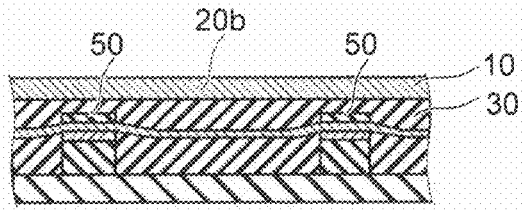

Then, as illustrated in FIG. 6G, the organic light-emitting unit 30 is formed on the insulating layer 50 and the conductive layer 20*b*; and the first electrode 10 is formed on the organic light-emitting unit 30.

Thereby, the illumination device 110 or the illumination device 111 can be manufactured.

In the illumination device 110 and the illumination device 111, the low refractive index portion 40*a* opposes the first interconnection 21 and the second interconnection 22 along the Z-axis direction; and the first interconnection 21 and the second interconnection 22 can be formed collectively with the low refractive index portion 40*a*. Therefore, the productivity is high.

FIG. 7A to FIG. 7G are schematic cross-sectional views in order of the processes, illustrating another method for manufacturing the illumination devices according to the first embodiment of the invention.

Namely, FIG. 7A to FIG. 7G illustrate the method for manufacturing the illumination device 110 or the illumination device 111 and are cross-sectional views corresponding to the cross section along line A1-A2 of FIG. 1B or FIG. 4B.

Figure 7A:
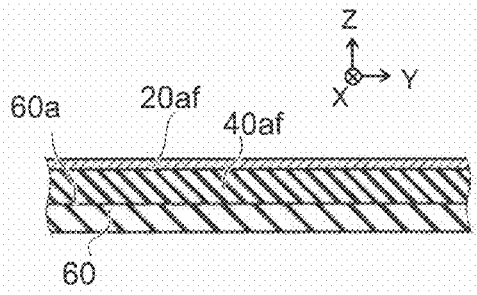
FIG. 7A to FIG. 7G are schematic cross-sectional views in order of the processes, illustrating another method for manufacturing the illumination devices according to the first embodiment.

First, as illustrated in FIG. 7A, the low refractive index film 40*af* is formed on the major surface 60*a* of the substrate 60; and the high conductivity film 20*af* is formed on the low refractive index film 40*af*.

Figure 7B:
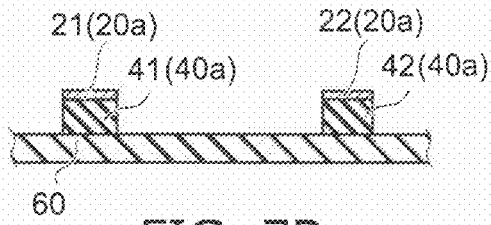

Then, as illustrated in FIG. 7B, the low refractive index film 40*af* and the high conductivity film 20*af* are patterned to form the first interconnection 21 and the second interconnection (the interconnection 20*a*) and the low refractive index portion 40*a*. In such a case as well, the patterning is performed collectively. Further, the third interconnection 23 and the fourth interconnection 24 may be collectively provided simultaneously with the low refractive index portion 40*a*, the first interconnection 21, and the second interconnection 22.

Figure 7C:
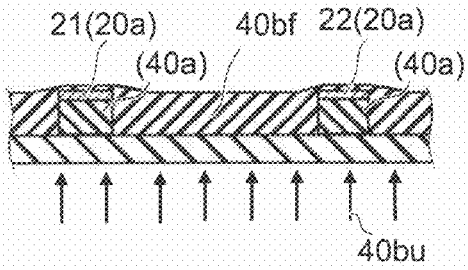

Continuing as illustrated in FIG. 7C, the high refractive index portion 40*b* is formed on the major surface 60*a* of the substrate 60 exposed between the low refractive index portion 40*a*, the first interconnection 21, and the second interconnection 22. In this specific example, a negative photosensitive material (e.g., photosensitive polyimide) is used as the high refractive index film 40*bf*.

Then, light 40*bu* is irradiated onto the high refractive index film 40*bf* from the face of the substrate 60 on the side opposite to the major surface 60*a* using the first interconnection and the second interconnection 22 as a mask; and developing is performed. Thereby, the portions of the high refractive index film 40*bf* irradiated with the light 40*bu* remain; and the portions screened by the first interconnection 21 and the second interconnection 22 and not irradiated with the light 40*bu* are removed.

Figure 7D:
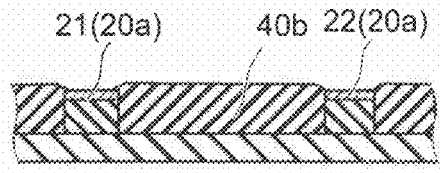

Thereby, as illustrated in FIG. 7D, the first interconnection 21 and the second interconnection 22 are exposed. Thus, the high refractive index portion 40*b* is formed.

Thus, in this specific example, the forming of the high refractive index portion 40*b* includes: forming the negative photosensitive high refractive index film 40*bf* used to form the high refractive index portion 40*b* to cover the low refractive index portion 40*a*, the first interconnection 21, the second interconnection 22, and the major surface 60*a* of the substrate 60; irradiating light onto the high refractive index film 40*bf* from the face of the substrate 60 on the side opposite to the major surface 60*a* using the first interconnection 21 and the second interconnection 22 as a mask; and performing developing. Thereby, the self-alignment makes positional alignment unnecessary; and the high refractive index portion 40*b* can be formed with high productivity.

Figure 7E:
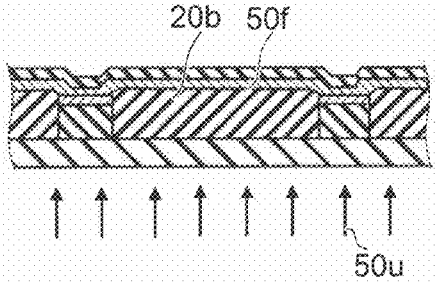
Figure 7F:
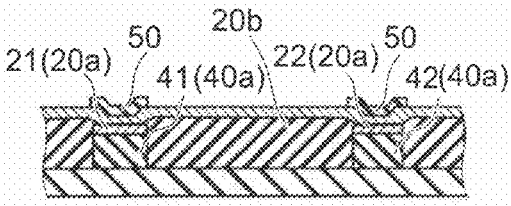
Figure 7G:
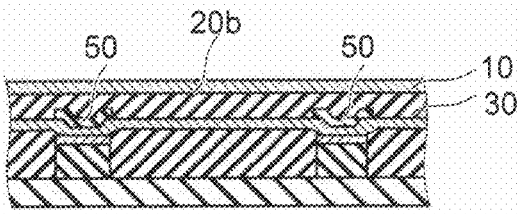

Thereafter, as illustrated in FIG. 7E to FIG. 7G, the illumination device 110 or the illumination device 111 can be manufactured by processes similar to those described in regard to FIG. 6E to FIG. 6G.

In such a manufacturing method as well, the first interconnection 21 and the second interconnection 22 are formed collectively with the low refractive index portion 40*a*; and the high refractive index portion 40*b* is formed with self-alignment with the first interconnection 21, the second interconnection 22, and the low refractive index portion 40*a*. Therefore, positional alignment is unnecessary; and the high refractive index portion 40*b* can be formed with high productivity.

In a comparative example, a diffraction grating is used as the optical layer provided on the side of the second electrode 20 opposite to the organic light-emitting unit 30. Such a comparative example corresponds to, for example, the configuration of the organic electroluminescent element discussed in JP-A 2006-156400 (Kokai). Thus, when a diffraction grating is applied as the optical layer, the disposition pitch between the high refractive index layer and the low refractive index layer is about the same as the wavelength of the light emitted from the organic light-emitting unit 30. For example, the disposition pitch between the high refractive index layer and the low refractive index layer is about 10 nm to 1 μm. Thereby, a diffraction effect occurs. Thus, it is necessary to provide the high refractive index layer and the low refractive index layer with extremely small pitches to use the diffraction effect; and the productivity is low. Further, because the disposition pitch between the high refractive index layer and the low refractive index layer differs greatly from the disposition pitch of the first interconnection 21 and the second interconnection 22 (e.g., not less than 100 μm and not more than 10 mm), it is difficult to form the high refractive index layer and the low refractive index layer collectively with the first interconnection 21 and the second interconnection 22.

Conversely, the illumination devices 110 and 111 according to this embodiment can be used as illumination devices having large surface areas. The nonuniform brightness in the plane due to the voltage drop, which is a problem characteristic to illumination devices having large surface areas, is suppressed by the interconnection 20*a* (the first interconnection 21 and the second interconnection 22) having the high conductivity; and a uniform light emission in the plane can be obtained.

Also, by providing the low refractive index portion 40*a* to oppose the reflective interconnection 20*a* (the first interconnection 21 and the second interconnection 22) having the low transmittance, the refraction effect of the interface IF1 between the low refractive index portion 40*a* and the high refractive index portion 40*b* is utilized; the optical path of the light L3 is changed; multiple reflections are suppressed; and the light L3 can be efficiently extracted to the external environment. Thus, in the illumination devices 110 and 111, a refraction effect different from the diffraction effect is utilized.

Further, the high refractive index portion 40*b* and the low refractive index portion 40*a* can be formed collectively with the first interconnection 21 and the second interconnection 22; and the productivity also is high.

It may be possible to apply a method that utilizes a diffraction effect to increase the outcoupling efficiency in a display device and the like in which, for example, one pixel has a size of about 200 μm and the voltage drop in the pixel electrode is not problematic. However, based on the approaches using diffraction gratings, it is considered to be difficult to practically realize both the suppression of the nonuniform brightness and the increase of the outcoupling efficiency which are characteristically necessary for illumination devices having large surface areas.

Conversely, in the illumination devices 110 and 111 according to this embodiment, the suppression of the nonuniform brightness and the increase of the outcoupling efficiency, which are characteristically necessary for illumination devices having large surface areas, can be simultaneously realized by utilizing the refraction effect and by providing the interconnection 20*a* having the high conductivity and the low refractive index portion 40*a* opposing the interconnection 20*a*. Thereby, the voltage drop in the plane is suppressed to obtain a uniform brightness; and a highly efficient illumination device with increased outcoupling efficiency can be provided.

Further, by providing the low refractive index portion 40*a* at a position corresponding to the interconnection 20*a* having the high conductivity, the interconnection 20*a*, which suppresses the voltage drop in the plane which is characteristic to illumination devices having large surface areas, can be constructed simultaneously with the low refractive index portion 40*a*, which increases the outcoupling efficiency. Thereby, the voltage drop in the plane is suppressed to obtain a uniform brightness; the outcoupling efficiency can be increased; and a highly efficient illumination device can be manufactured with high productivity.

Second Embodiment

Figure 8A:
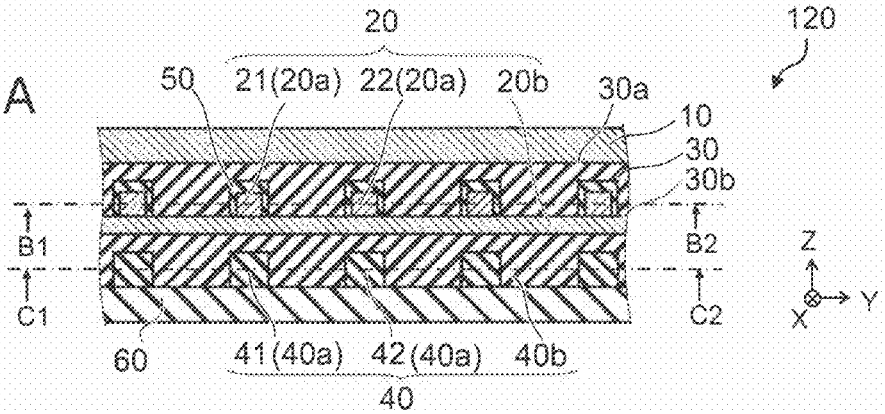
FIG. 8A to FIG. 8C are schematic views illustrating the configuration of an illumination device according to a second embodiment.
Figure 8B:
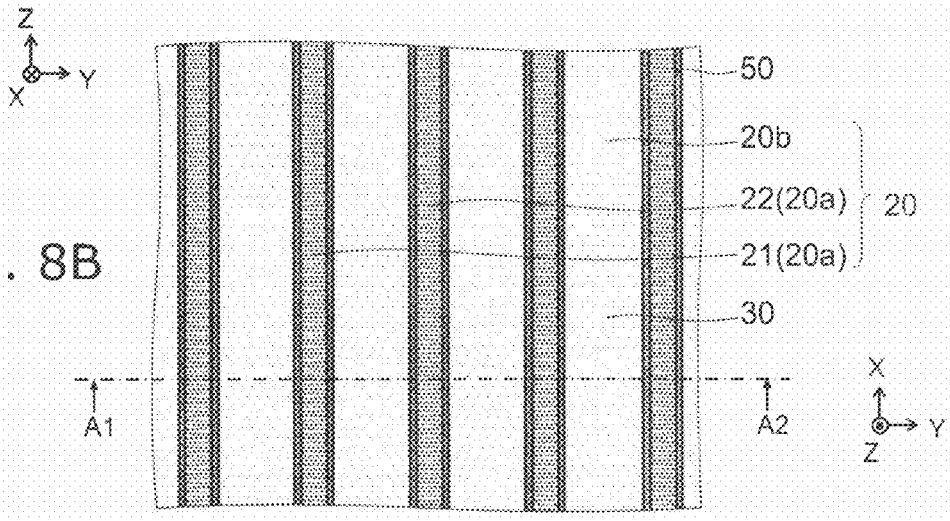
Figure 8C:
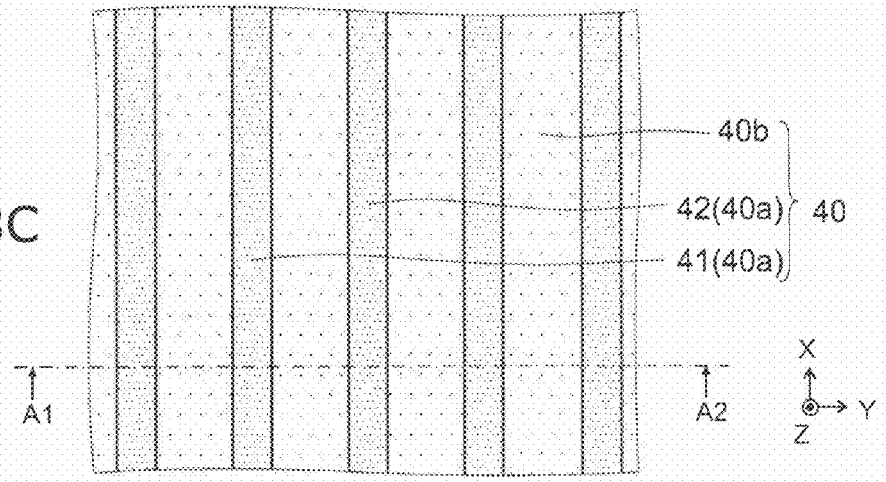

FIG. 8A to FIG. 8C are schematic views illustrating the configuration of an illumination device according to a second embodiment of the invention.

Namely, FIG. 8A is a cross-sectional view along line A1-A2 of FIG. 8B and FIG. 8C; FIG. 8B is a cross-sectional view along line B1-B2 of FIG. 8A; and FIG. 8C is a cross-sectional view along line C1-C2 of FIG. 8A.

In the illumination device 120 according to this embodiment as illustrated in FIG. 8A to FIG. 8C, the first interconnection 21 and the second interconnection 22 are provided on the organic light-emitting unit 30 side of the conductive layer 20*b*.

An insulating layer is provided between the first interconnection 21 and the organic light-emitting unit 30 and between the second interconnection 22 and the organic light-emitting unit 30 and has a portion overlapping at least one selected from the first interconnection 21 and the second interconnection 22 as viewed from the Z-axis direction (the direction perpendicular to the first major surface 30*a*). The insulating layer 50 covers the first interconnection 21 and the second interconnection 22 and electrically insulates the first interconnection 21 and the second interconnection 22 from the organic light-emitting unit 30. Otherwise, the configuration is similar to that of the illumination device 110, and a description is therefore omitted.

The illumination device 120 according to this embodiment also suppresses the voltage drop in the plane to obtain a uniform brightness; and a highly efficient illumination device with increased outcoupling efficiency can be provided.

In the illumination device 120, the thickness of the low refractive index portion 40*a* along the Z-axis direction is thinner than the thickness of the high refractive index portion 40*b* along the Z-axis direction. In other words, the low refractive index portion 40*a* is covered with the high refractive index portion 40*b*; and the low refractive index portion 40*a* is buried in the high refractive index portion 40*b*.

Figure 9A:
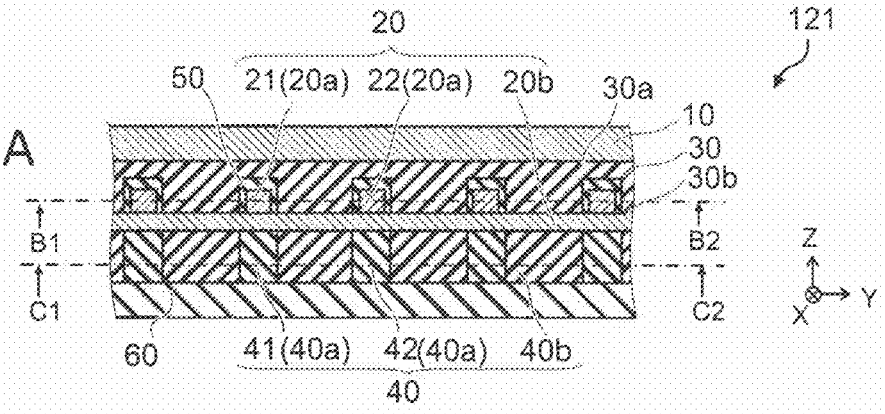
FIG. 9A to FIG. 9C are schematic views illustrating the configuration of another illumination device according to the second embodiment.
Figure 9B:
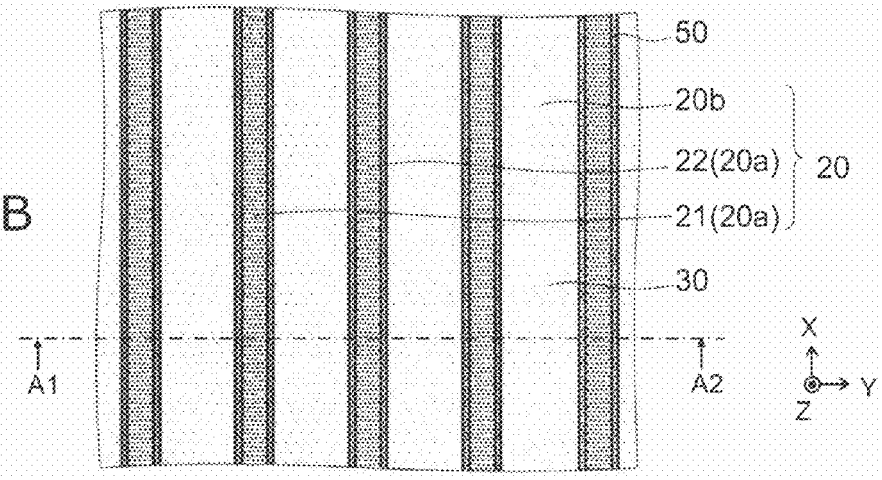
Figure 9C:
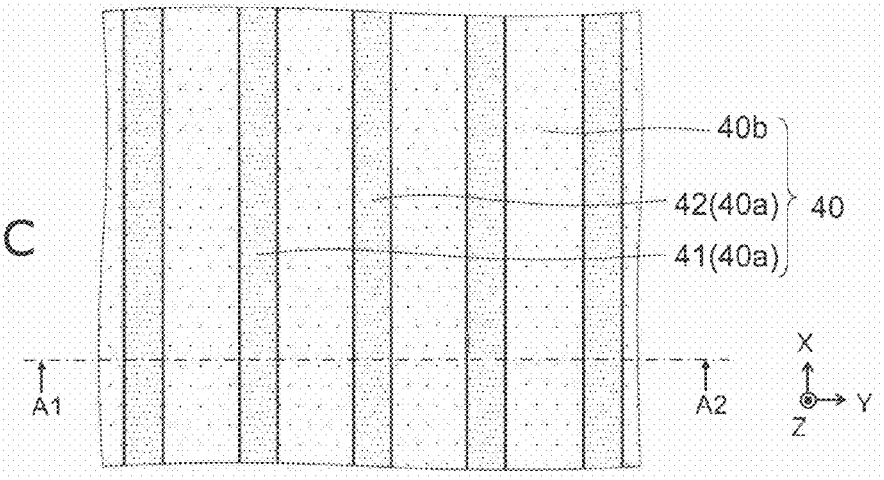

FIG. 9A to FIG. 9C are schematic views illustrating the configuration of another illumination device according to the second embodiment of the invention.

Namely, FIG. 9A is a cross-sectional view along line A1-A2 of FIG. 9B and FIG. 9C; FIG. 9B is a cross-sectional view along line B1-B2 of FIG. 9A; and FIG. 9C is a cross-sectional view along line C1-C2 of FIG. 9A.

Also in the one other illumination device 121 according to this embodiment as illustrated in FIG. 9A to FIG. 9C, the first interconnection 21 and the second interconnection 22 are provided on the organic light-emitting unit 30 side of the conductive layer 20*b*. An insulating layer is provided between the first interconnection 21 and the organic light-emitting unit 30 and between the second interconnection 22 and the organic light-emitting unit 30 and has a portion overlapping at least one selected from the first interconnection 21 and the second interconnection 22 as viewed from the Z-axis direction.

In the illumination device 121, the thickness of the low refractive index portion 40*a* along the Z-axis direction is substantially the same as the thickness of the high refractive index portion 40*b* along the Z-axis direction.

The illumination device 121 also suppresses the voltage drop in the plane to obtain a uniform brightness; and a highly efficient illumination device with increased outcoupling efficiency can be provided.

Figure 10A:
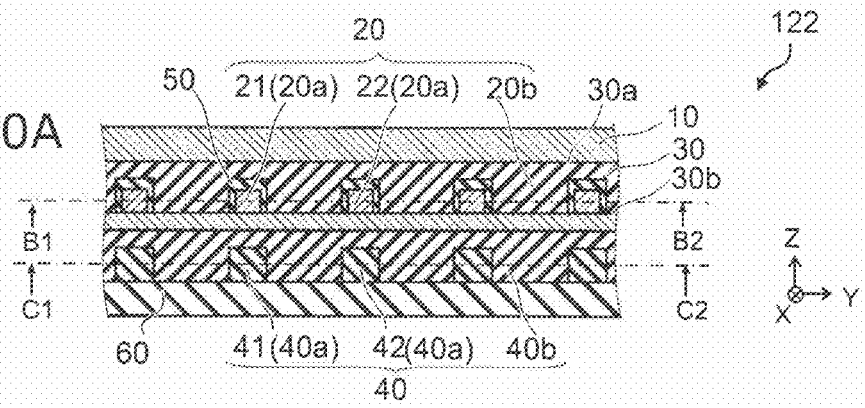
FIG. 10A to FIG. 10C are schematic views illustrating the configuration of still another illumination device according to the second embodiment.
Figure 10B:
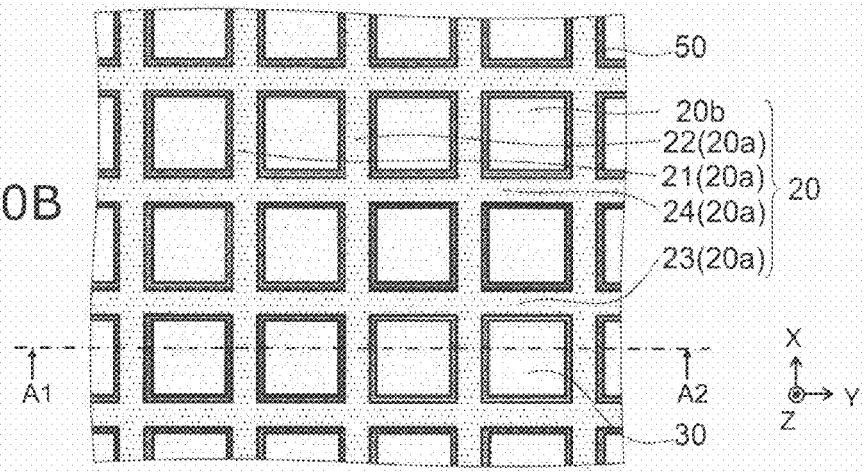
Figure 10C:
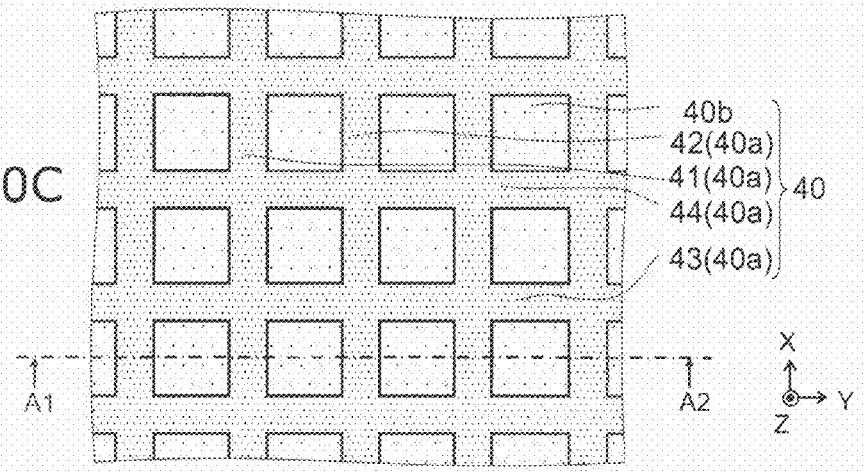

FIG. 10A to FIG. 10C are schematic views illustrating the configuration of still another illumination device according to the second embodiment of the invention.

Namely, FIG. 10A is a cross-sectional view along line A1-A2 of FIG. 10B and FIG. 10C; FIG. 10B is a cross-sectional view along line B1-B2 of FIG. 10A; and FIG. 10C is a cross-sectional view along line C1-C2 of FIG. 10A.

As illustrated in FIG. 10A to FIG. 10C, the still another illumination device 122 according to this embodiment also includes the first electrode 10, the second electrode 20, the organic light-emitting unit 30, and the optical layer 40. The second electrode 20 further includes the third interconnection 23 and the fourth interconnection 24. The first interconnection 21, the second interconnection 22, the third interconnection 23, and the fourth interconnection 24 are provided on the organic light-emitting unit 30 side of the conductive layer 20*b*. The insulating layer 50 is provided between the first interconnection 21 and the organic light-emitting unit 30, between the second interconnection 22 and the organic light-emitting unit 30, between the third interconnection 23 and the organic light-emitting unit 30, and between the fourth interconnection 24 and the organic light-emitting unit 30 and has portions overlapping the first interconnection 21, the second interconnection 22, the third interconnection 23, and the fourth interconnection 24 in the Z-axis direction.

The illumination device 122 also suppresses the voltage drop in the plane to obtain a uniform brightness; and a highly efficient illumination device with increased outcoupling efficiency can be provided.

In the illumination device 122, the thickness of the low refractive index portion 40*a* along the Z-axis direction is thinner than the thickness of the high refractive index portion 40*b* along the Z-axis direction. However, similarly to the illumination device 121, the thickness of the low refractive index portion 40*a* along the Z-axis direction may be set to be substantially the same as the thickness of the high refractive index portion 40*b* along the Z-axis direction.

Third Embodiment

A third embodiment of the invention is a method for manufacturing the illumination device. In other words, this manufacturing method is a method for manufacturing an illumination device including: the organic light-emitting unit 30 having the first major surface 30*a* and the second major surface 30*b*; the first electrode 10 provided on the first major surface 30*a* of the organic light-emitting unit 30; the second electrode 20 provided on the second major surface 30*b* of the organic light-emitting unit 30, where the second electrode 20 includes the conductive layer 20*b*, the first interconnection 21 electrically connected to the conductive layer 20 and aligned in the first direction parallel to the first major surface 30*a*, and the second interconnection 22 electrically connected to the conductive layer 20*b* and aligned apart from the first interconnection 21 and parallel to the first interconnection 21, the conductivities of the first interconnection 21 and the second interconnection 22 being higher than that of the conductive layer 20*b*; and the optical layer 40 provided on the side of the second electrode 20 opposite to the organic light-emitting unit 30, where the optical layer 40 includes the low refractive index portion 40*a* having a portion overlapping at least one selected from the first interconnection 21 and the second interconnection 22 as viewed from the direction perpendicular to the first major surface 30*a* and the high refractive index portion 40*b* having a portion contacting the portion of the low refractive index portion 40*a* recited above and having a refractive index higher than that of the low refractive index portion 40*a*.

Figure 11:
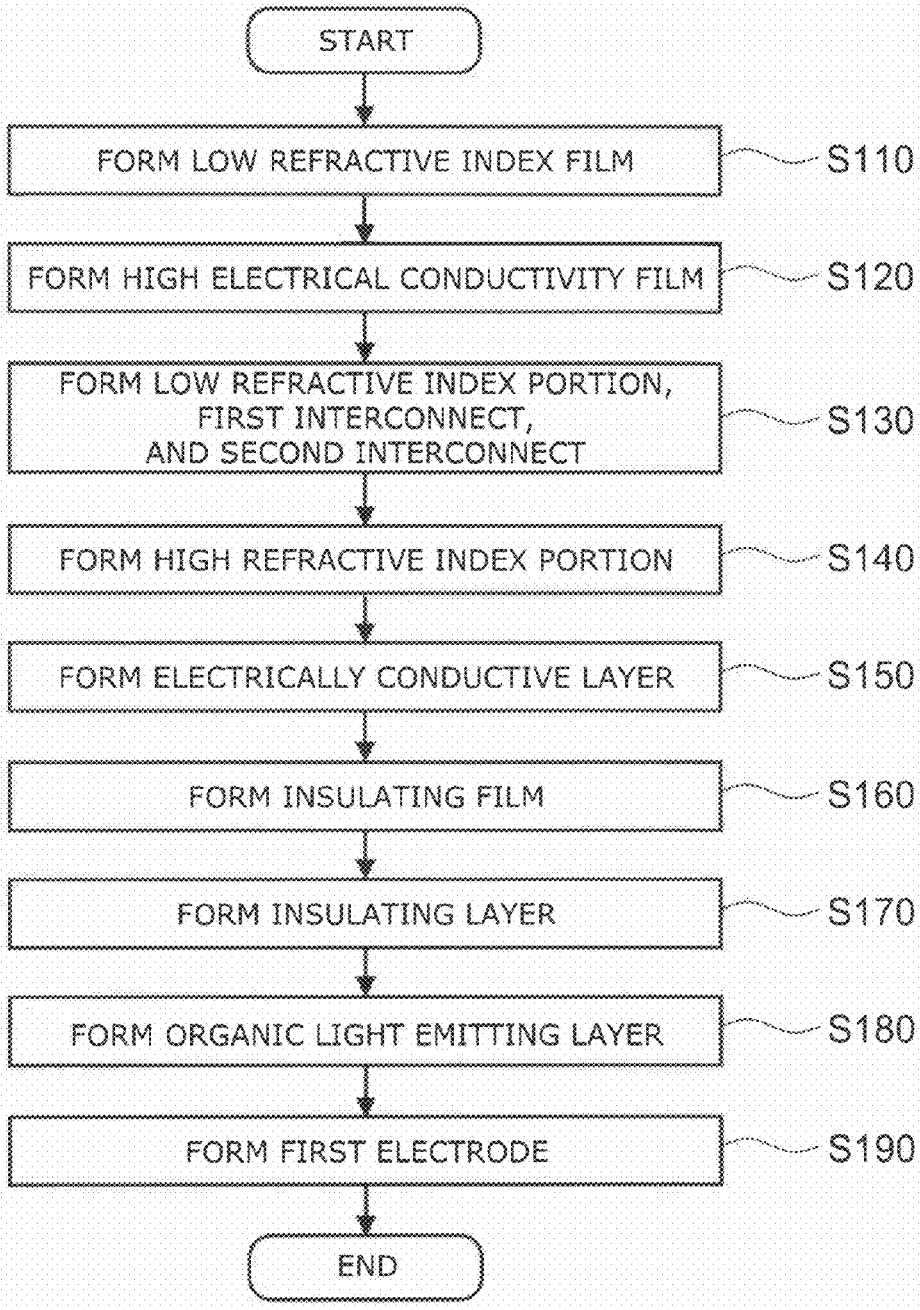
FIG. 11 is a flowchart illustrating a method for manufacturing an illumination device according to a third embodiment.

FIG. 11 is a flowchart illustrating the method for manufacturing an illumination device according to the third embodiment of the invention.

In the method for manufacturing an illumination device according to this embodiment as illustrated in FIG. 11, first, the low refractive index film 40*af* used to form the low refractive index portion 40*a* is formed on the major surface 60*a* of the substrate 60 (step S110).

Then, the high conductivity film 20*af* used to form the first interconnection 21 and the second interconnection 22 is formed on the low refractive index film 40*af* (step S120).

Continuing, the low refractive index film 40*af* and the high conductivity film 20*af* are patterned to form the low refractive index portion 40*a*, the first interconnection 21, and the second interconnection 22 (step S130).

Then, the high refractive index portion 40*b* is formed on the major surface 60*a* of the substrate 60 exposed between the low refractive index portion 40*a*, the first interconnection 21, and the second interconnection 22 (step S140).

Continuing, the conductive layer 20*b* is formed to cover the low refractive index portion 40*a*, the first interconnection 21, the second interconnection 22, and the high refractive index portion 40*b* (step S150).

Then, the photosensitive insulating film 50*f* is formed on the conductive layer 20*b* (step S160). Then, light is irradiated onto the insulating film 50*f* from the face of the substrate 60 on the side opposite to the major surface 60*a* using the first interconnection 21 and the second interconnection 22 as a mask; developing is performed; and the insulating layer 50 made of the insulating film 50*f* is formed with a patterned configuration conforming to the patterned configuration of the first interconnection 21 and the second interconnection 22 (step S170).

Continuing, the organic light-emitting unit 30 is formed on the insulating layer 50 and the conductive layer 20*b* (step S180).

Then, the first electrode 10 is formed on the organic light-emitting unit 30 (step S190).

In other words, for example, the method described in regard to FIG. 6A to FIG. 6G is implemented.

According to such a manufacturing method, the first interconnection 21 and the second interconnection 22 can be formed collectively with the low refractive index portion 40*a*; the voltage drop in the plane is suppressed to obtain a uniform brightness; and a highly efficient illumination device with increased outcoupling efficiency can be manufactured with high productivity.

As described above in regard to FIG. 7A to FIG. 7G, the forming of the high refractive index portion 40*b* may include: forming the negative photosensitive high refractive index film 40*bf* used to form the high refractive index portion 40*b* to cover the low refractive index portion 40*a*, the first interconnection 21, the second interconnection 22, and the major surface 60*a* of the substrate 60; irradiating light onto the high refractive index film 40*bf* from the face of the substrate 60 on the side opposite to the major surface 60*a* using the first interconnection 21 and the second interconnection 22 as a mask; and performing developing. Thereby, the self-alignment makes positional alignment unnecessary; and the high refractive index portion 40*b* can be formed with high productivity.

Hereinabove, exemplary embodiments of the invention are described with reference to specific examples. However, the invention is not limited to these specific examples. For example, one skilled in the art may similarly practice the invention by appropriate selections from known art, including various modifications made by one skilled in the art in regard to configurations, sizes, material qualities, arrangements, and the like of specific configurations of components included in illumination devices such as first electrodes, second electrodes, conductive layers, interconnections, organic light-emitting layers, organic light-emitting units, optical layers, high refractive index portions, low refractive index portions, insulating layers, and the like. Such practice is included in the scope of the invention to the extent that similar effects thereto are obtained.

Further, any two or more components of the specific examples may be combined within the extent of technical feasibility; and are included in the scope of the invention to the extent that the purport of the invention is included. Moreover, all illumination devices practicable by an appropriate design modification by one skilled in the art based on the illumination devices described above as embodiments of the invention also are within the scope of the invention to the extent that the purport of the invention is included.

Furthermore, various modifications and alterations within the spirit of the invention will be readily apparent to those skilled in the art. All such modifications and alterations should therefore be seen as within the scope of the invention.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the invention.

The invention claimed is:

1. An illumination device, comprising:

a transparent substrate;

a first electrode;

an organic light-emitting unit provided between the transparent substrate and the first electrode, the organic light-emitting unit including an organic light-emitting layer, the organic light-emitting unit having a first major surface facing the first electrode;

a second electrode provided between the transparent substrate and the organic light-emitting unit, the second electrode including, a conductive layer, a first interconnection electrically connected to the conductive layer and extending in a first direction parallel to the first major surface, the first interconnection having a conductivity higher than a conductivity of the conductive layer, the first interconnection overlapping the organic light-emitting unit as viewed from a normal direction perpendicular to the first major surface, and a second interconnection electrically connected to the conductive layer, being apart from the first interconnection and extending in a first direction, the second interconnection overlapping the organic light-emitting unit as viewed from the normal direction, the second interconnection having a conductivity higher than the conductivity of the conductive layer;

an optical layer provided between the transparent substrate and the second electrode, the optical layer including, a low refractive index portion contacting the transparent substrate, the low refractive index portion overlapping the first interconnection and the second interconnection as viewed from the normal direction, and a high refractive index portion contacting the transparent substrate and contacting the low refractive index portion, a refractive index of the high refractive index portion being higher than a refractive index of the low refractive index portion and higher than a refractive index of the transparent substrate; and an insulating layer provided between the second electrode and the organic light-emitting unit, the insulating layer overlapping the first interconnection and the second interconnection as viewed from the normal direction, the insulating layer formed in part by using the first interconnection and the second interconnection as a mask to irradiate light onto an insulating film through the transparent substrate, the insulating film so formed serving as the insulating layer.

2. The device according to claim 1, wherein a width of the first interconnection along a second direction perpendicular to the first direction and parallel to the first major surface is greater than 10 micrometers and a width of the second interconnection along the second direction is greater than 10 micrometers.

3. The device according to claim 1, wherein a distance along a second direction perpendicular to the first direction and parallel to the first major surface from a center of the first interconnection along the second direction to a center of the second interconnection along the second direction is not less than 10 times a width of the first interconnection along the second direction and not less than 10 times a width of the second interconnection along the second direction.

4. The device according to claim 1, wherein a width along a second direction perpendicular to the first direction and parallel to the first major surface of the portion of the low refractive index portion overlapping the at least one selected from the first interconnection and the second interconnection as viewed from the direction perpendicular to the first major surface is not less than 10 micrometers.

5. The device according to claim 1, wherein the second electrode further includes:

a third interconnection electrically connected to the conductive layer, the first interconnection, and the second interconnection and aligned in a third direction different from the first direction and parallel to the first major surface, the third interconnection having a conductivity higher than the conductivity of the conductive layer; and a fourth interconnection electrically connected to the conductive layer, the first interconnection, and the second interconnection and aligned apart from the third interconnection and parallel to the third interconnection, the fourth interconnection having a conductivity higher than the conductivity of the conductive layer.

6. The device according to claim 5, wherein the low refractive index portion further has a portion overlapping at least one selected from the third interconnection and the fourth interconnection as viewed from the direction perpendicular to the first major surface.

7. The device according to claim 5, wherein a width of the third interconnection along a fourth direction perpendicular to the third direction and parallel to the first major surface is greater than 10 micrometers and a width of the fourth interconnection along the fourth direction is greater than 10 micrometers.

8. The device according to claim 5, wherein a distance along a fourth direction perpendicular to the third direction and parallel to the first major surface from a center of the third interconnection along the fourth direction to a center of the fourth interconnection along the fourth direction is not less than 10 times a width of the third interconnection along the fourth direction and not less than 10 times a width of the fourth interconnection along the fourth direction.

9. The device according to claim 5, wherein distances along the direction perpendicular to the first major surface from the third interconnection to the first electrode and from the fourth interconnection to the first electrode are identical to distances along the direction perpendicular to the first major surface from the first interconnection to the first electrode and from the second interconnection to the first electrode.

10. The device according to claim 1, wherein the conductive layer is translucent to a light emitted from the organic light-emitting unit, and transmittances of the first interconnection and the second interconnection with respect to the light are lower than a transmittance of the conductive layer with respect to the light.

11. The device according to claim 1, wherein the first interconnection and the second interconnection are reflective with respect to a light emitted from the organic light-emitting unit.

12. The device according to claim 11, wherein the light emitted from the organic light-emitting unit is refracted based on a difference of refractive indexes of the low refractive index portion and the high refractive index portion in traveling from the high refractive index portion into the low refractive index portion.

13. The device according to claim 1, wherein the first interconnection and the second interconnection are provided on a side of the conductive layer opposite to the organic light-emitting unit and the insulating layer is provided between the conductive layer and the organic light-emitting unit.

14. The device according to claim 1, wherein the first interconnection and the second interconnection are provided on the organic light-emitting unit side of the conductive layer and the insulating layer is provided between the first interconnection and the organic light-emitting unit and between the second interconnection and the organic light-emitting unit.

15. The device according to claim 1, wherein a width of the first interconnection along a second direction perpendicular to the first direction and parallel to the first major surface is not more than 1000 micrometers and a width of the second interconnection along the second direction is not more than 1000 micrometers.

16. The device according to claim 1, wherein a distance along a second direction perpendicular to the first direction and parallel to the first major surface from a center of the first interconnection along the second direction to a center of the second interconnection along the second direction is not less than 100 micrometers and not more than 10 millimeters.

17. The device according to claim 1, wherein a width along a second direction perpendicular to the first direction and parallel to the first major surface of the portion of the low refractive index portion overlapping the at least one selected from the first interconnection and the second interconnection as viewed from the direction perpendicular to the first major surface is not less than 100 micrometers and not more than 1000 micrometers.

18. The device according to claim 1, wherein the insulating layer is buried in the organic light-emitting unit.

* * * * *